United States Patent [19]

Schonhardt

[11] 4,320,480

[45] Mar. 16, 1982

[54] SWITCH CHAIN WITH SWITCH RIDERS FOR SWITCH CLOCKS

[75] Inventor: Peter Schonhardt, St. Georgen, Fed. Rep. of Germany

[73] Assignee: Dieter Graesslin Feinwerktechnik, Fed. Rep. of Germany

[21] Appl. No.: 145,747

[22] Filed: May 1, 1980

[51] Int. Cl.[3] ..... G04B 19/20; B65H 25/14

[52] U.S. Cl. ..... 368/78; 368/233; 200/61.14

[58] Field of Search ..... 200/37 R, 19 TS, 23, 200/61.13, 61.14; 368/62, 41–45, 76, 77, 78, 223, 229, 231, 232, 233, 235

[56] References Cited

U.S. PATENT DOCUMENTS

| | | | |
|---|---|---|---|
| 700,454 | 5/1902 | Thrasher | 368/78 X |
| 2,248,293 | 7/1941 | Woolf et al. | 200/61.14 |
| 3,424,879 | 1/1969 | Shlesinger | 200/61.14 |
| 3,747,321 | 7/1973 | Yudewitz | 368/41 X |
| 3,956,879 | 5/1976 | Bailey | 368/76 |

*Primary Examiner*—Vit W. Miska

*Attorney, Agent, or Firm*—Hill, Van Santen, Steadman, Chiara & Simpson

[57] ABSTRACT

A switch programming mechanism is afforded by means of an endless switch chain. The switch chain is provided with switch riders or triggers serving as mechanical abutments for the actuation of the switch. The switch chain may be formed with tooth elements having truncated inner ends and being axially displaceable on their interconnection means relative to one another. The switch chain is particularly well suited for fitting within the confines of a ordinal-display switch clock and for controlling the operation thereof.

12 Claims, 5 Drawing Figures

SWITCH CHAIN WITH SWITCH RIDERS FOR SWITCH CLOCKS

BACKGROUND OF THE INVENTION

A. Field of the Invention

The invention relates to switch triggering means and, more particularly, to a triggering assembly for programming the electrical switch for a switch clock.

B. The Prior Art

Ordinal switch clocks, viz. clocks which indicate the time by means of ordinal numbers affixed to mechanically driven surfaces, often utilize electrical switch devices for changing over time display numbers. Switch actuation is based on a switching program carried out by switch triggers, made to pass into engagement with switch actuation means. It is often necessary that the switching program have a 24-hour range, so that A.M. and P.M. times may be indicated by the clock. Due to the spatial housing dimensions for such switch clocks which are often standardized, however, indexing disks carrying the switch triggers must very often be fitted with an outer circumference too small in diameter for the arrangement of the switch triggers in sequential order, since a certain amount of spatial width must be given the switch triggers to allow for expedient surfaces. Servicing is then difficult.

Continuous chain means with switch triggers attached to each link has not been a viable switch programming mechanism in the past, because the division between the individual chain elements or links was too large to permit compact placement. Furthermore, known chains require switch triggers or riders that are attachable, such that these can be lost and require separate outlay for manufacture.

SUMMARY OF THE INVENTION

The present invention relates to an economical switch program chain having integrally formed switch triggers able to travel along relatively small turn radii.

The chain according to the present invention is of a continuous one-piece construction. The chain elements or links are formed as interconnected teeth members which are compactly arranged and relatively pivotable, making it possible to turn the chain through rectangular or square corners. The teeth are each formed with an integral switch trigger element.

By virtue of the triggers of the chain being programmably arranged about the length of the chain, the switching program may be signaled to an electrical switch device as the chain passes its switch trigger means into contact with switch actuator means.

DESCRIPTION OF THE PREFERRED EMBODIMENTS

Preferably, a switch chain according to the present invention is manufactured from a synthetic resin material so as to be economical; however, those skilled in the art will readily appreciate that other materials, such as a sintered metallic, may also be utilized.

Figure 1:
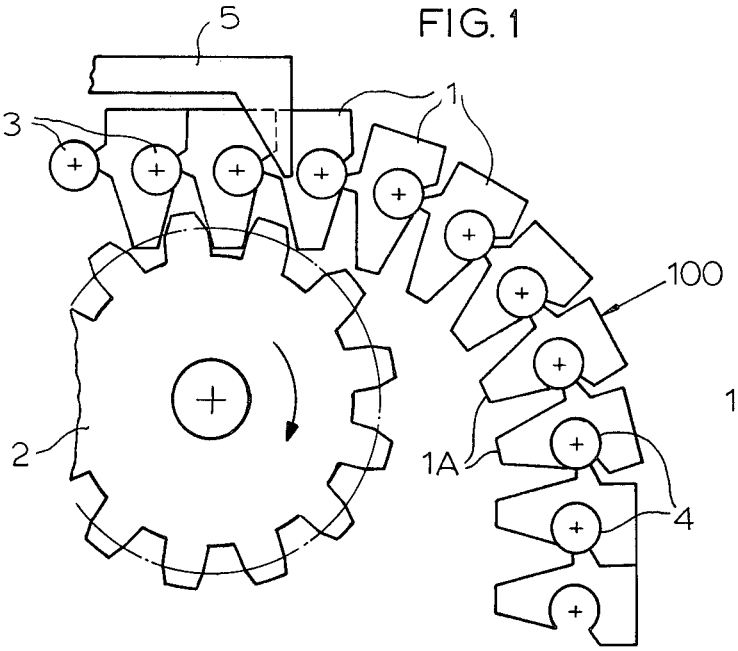
FIG. 1 is a cross-sectional view of a switch chain according to the present invention.

FIG. 1 illustrates a switch chain 100 according to the present invention. The chain 100 is a continuous, one-piece linkage of elements 1. The chain elements 1 are in the form of teeth, which are designed and dimensioned to fit in driving relationship with the tooth spaces of a pinion 2. The pinion 2 may be a free-wheeling bearing gear or a drive pinion for driving displacement of the chain 100.

The inner, pinion-facing surfaces 1A of the teeth 1 are convergently shaped toward their inner ends. This truncation allows the teeth 1 to turn sharply about a relatively small radius without engaging with the inner end surfaces of adjacent teeth. Further, in this regard, the teeth are relatively pivotable to one another by means of their interconnection means 3, 4. The backside of each tooth 1 is formed with a male bearing or guidance peg 3 which can be pressed axially, i.e., laterally to the driving direction of the chain 100, into a congruent groove 4 the front side of the succeeding tooth. For purposes of the preferred embodiment, the guide pins 3 and bearing grooves 4 utilized in FIG. 1 are of a circular cross-section. In this manner, the forward tooth is pivotable on a pivot arm formed by its guidance peg 3 about the axis of the guidance groove 4 in the next adjacent tooth and each individual tooth is relatively axially displaceable in the chain.

The teeth 1 are integrally formed with switch rider or trigger means. In this regard, the pegs 3 may be of a width greater than the teeth elements and extend axially outward from their receiving grooves 4, so as to engage a switch actuator mechanism, such as lever 5 shown in FIG. 1. It is also within the contemplation of the present invention, however, to attach special trip members or cams to the teeth 1 if this creates a more practical switch trigger mechanism for the chain 100.

Guide means may be provided to maintain the teeth elements of the switch chain 100 within its spatial confines and to maintain trigger members in proper alignment or engagement with the switch actuator mechanism. In this regard, the upper, pinion-opposed surfaces may be provided with guide grooves which ride over guide surfaces extending from adjacent walls over which the chain 100 travels. Alternatively or in addition to the guide grooves, a guide surface or plate may be provided over which the inner ends 1A of the chain teeth 1 may travel.

Figure 2:
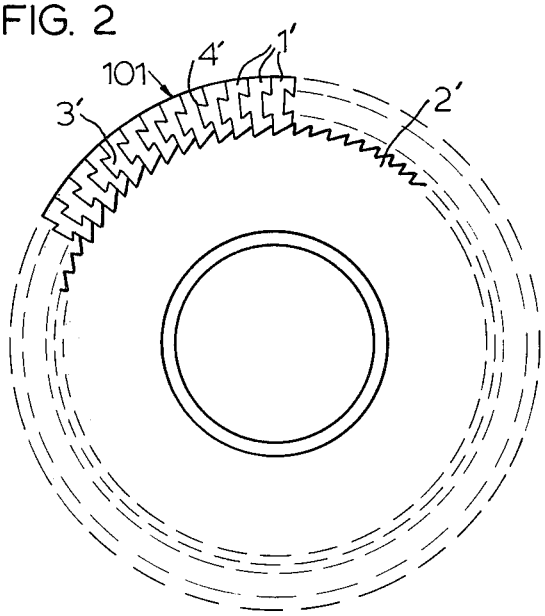
FIG. 2 is a partly schematic cross-sectional view of a switch chain according to a different embodiment of the present invention.

FIG. 2 illustrates an alternate form 101 of the switch chain according to the present invention. Chain 101 is provided with teeth elements 1' which slidably interfit together to form a closed chain about a single drive pinion 2'. The pitch diameter of the pinion 2' corresponds to the pitch diameter of the chain 101. In this manner, a circular switch program arrangement can be achieved which is in the form of an indexing disk.

In the circular chain arrangement 101, the teeth 1' are each formed with male peg members 3' and female grooves 4' at opposed side surfaces. The pegs 3' and grooves 4' respectively engage with one another across adjacent teeth so as to form substantially rigid interlocked chain elements. As illustrated in FIG. 2, the male and female interconnection members are of a swallow-tail shape; however, other shapes such as T-shaped or omega-shaped cross-sections may also be utilized.

Figure 5:
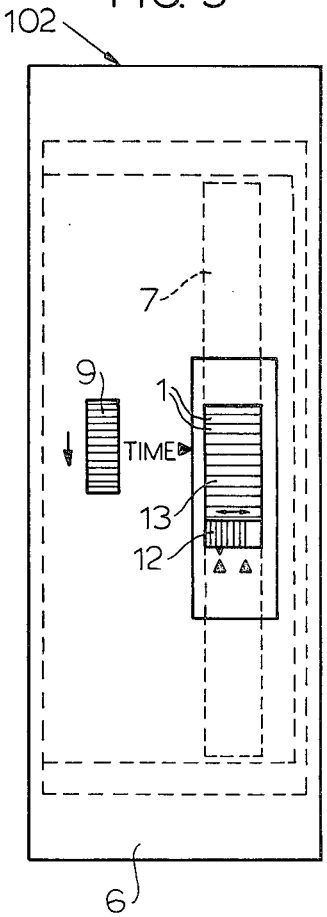
FIG. 5 is a front elevational view of the switch clock according to FIG. 3.
Figure 3:
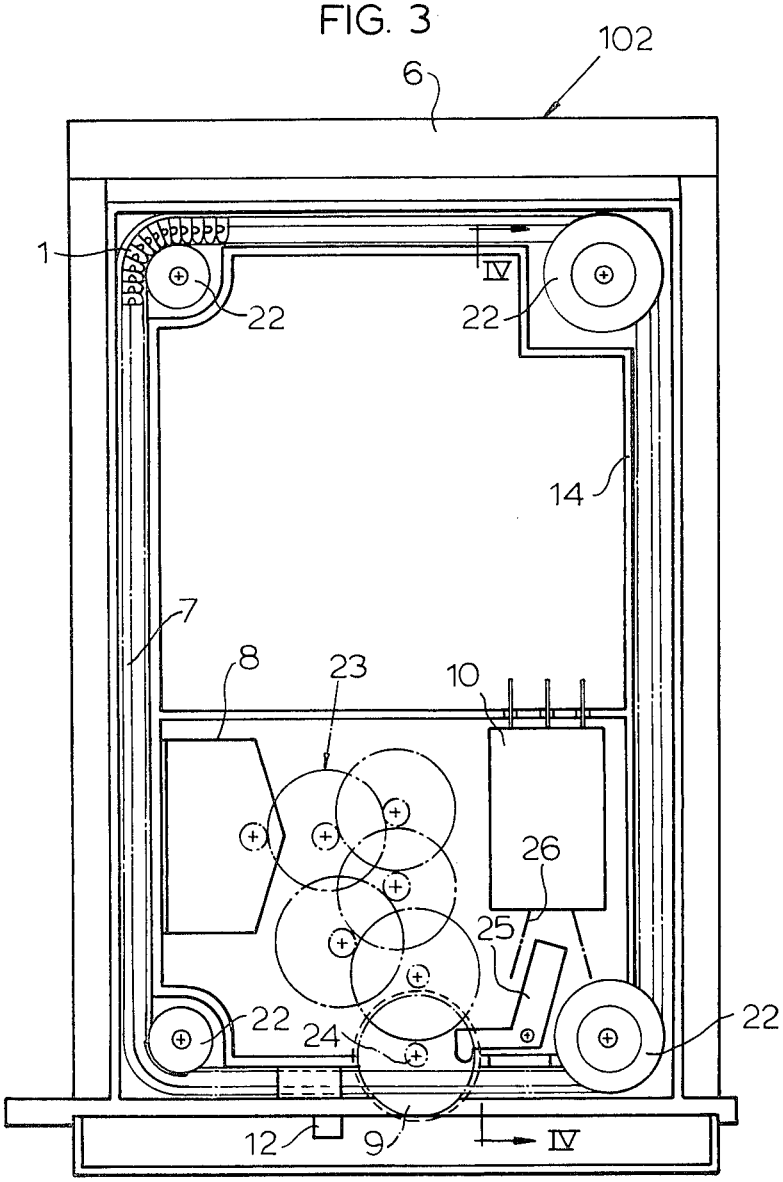
FIG. 3 is a partly schematic cross-sectional view of a time-display switch clock utilizing a switch chain according to FIG. 1.
Figure 4:
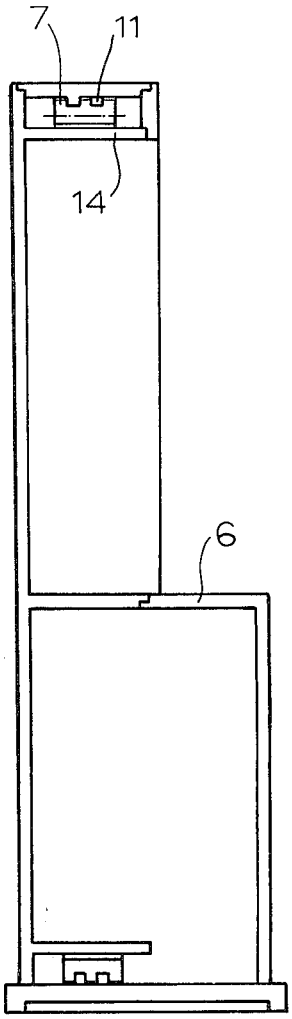
FIG. 4 is a cross-sectional view taken along the lines IV—IV of FIG. 3 and showing guide surfaces for the switch chain.

FIGS. 3–5 illustrate a time ordinal-display clock 102 of the switch clock variety incorporating a switch chain of the type illustrated in FIG. 1. The switch chain 7 is seated on bearing pinions 22 and extends closely about the inner wall edges of the clock housing 6. A synchronous motor drive 8 acts through a gear train drive transmission 23 to operate a drive pinion 24 engaging with the truncated teeth inner ends of the switch chain 7. The switch chain 7 can be manually moved on the drive pinion 24 by means of an adjustment wheel 9 connected thereto and provided for the purpose of setting the display time.

Actuation of the synchronous motor means 8 and, hence, advancement of the time display is controlled by an electrical switch mechanism 10. The program for actuating the switch 10 is set up on the switch chain 7 by virtue of the axial placement of switch trigger abutments, such as axial extensions of the interconnection pegs 3, along the chain length. A switch actuation means, in the form of a lever 25 is engaged on one side of its fulcrum by the switch triggers as the chain 7 is passed beneath the lever. As a switch trigger engages the lever 25, the lever is cammed about its fulcrum. The opposed end of the lever 25 is mechanically interconnected with an arm means 26. Movement of the arm 26 effects opening and closing of the switch 10.

As illustrated in FIG. 4, the upper surfaces of the chain teeth are provided with guide grooves 11 which ride over corresponding guide surfaces extending from the adjacent inner surfaces of the clock housing 6. Interior of the clock housing walls and located on the opposed side of the switch chain 7 from the housing walls is a guide wall surface or plate means 14. The guide wall 14 extends between the bearing pinions 22 such that the inner ends of the switch chain teeth are supported along a linear travel path between the pinions.

Operation of the switch clock 102 may be described as follows, with reference to FIG. 5. The upper surfaces of the chain teeth elements are designated with time ordinals. For illustration purposes, adjacent teeth of the switch chain 7 may designated by one minute intervals and the switch chain 7 may have a 12-hour range of time display. A slide mechanism 12 connected with surface edges interior of the clock housing 6 for frictional engagement of the switch chain 7 teeth element. The chain may then be manually driven by the adjustment wheel 9 until the particular chain tooth indicating the proper time is lined up a "time" indicator on the clock housing. The chain teeth are viewable through a window 13 located above the slide 12 on the clock housing. After the time has been set, the programming of the switch chain 7 directs the automatic clock operation. The pitch of the individual teeth elements and their relative distance from one another are time-dependent, serving as time markers with respect to a spatially stationary reference point. In this manner, a switch trigger connected with a particular chain tooth engages the actuator lever 25 which, thereby, closes the clock switch 10. After a particular time delay built into the clock circuit controlled by the switch 10 (the time delay here would almost correspond to one minute), the motor means 8 is momentarily activated to advance the switch chain 7 one tooth width, bringing the next further tooth in line with the clock's "time" indicator. With each instance that a particular switch trigger advances from beneath the lever 25, the lever moves downward about its fulcrum, causing the switch 10 to be opened. However, before the switch chain becomes halted, the next succeeding tooth is brought forward so that its trigger abutment again cams the lever 25 upward about its fulcrum to effect closing of the switch 10. Thus, the process repeats.

It is also within the contemplation of the present invention that other forms of endless drive means other than those here described, such as for example a perforated tape or standard chain, may be programmed with switch riders or triggers to provide a switch program in accordance with the present invention.

Although various minor modifications may be suggested by those versed in the art, it should be understood that I wish to embody within the scope of the patent warranted hereon all such modifications as reasonably and properly come within the scope of my contribution to the art.

I claim as my invention:

1. A programming apparatus for controlling a switch comprising a continuous linkage of individual elements, respective switch trigger means integrally formed on each said element, a switch actuator means for activation of said switch when engaged with said trigger means, means for driving said linkage past said switch actuator means, and means for interconnecting said elements such that each said element is relatively displaceable laterally of the driving direction of said linkage.

2. The apparatus of claim 1, wherein said interconnection means comprises corresponding peg and groove members integrally formed on adjacent element surfaces.

3. The apparatus of claim 2, wherein said peg and groove members are swallow-tail shaped.

4. The apparatus of claim 1, wherein said trigger means comprises laterally extending abutment surfaces and said switch actuator means includes an actuator lever having one end positioned laterally adjacent said linkage.

5. A switch clock programming apparatus, which controls actuation of an electrical switch for generating time signals, comprising an endless chain having a plurality of individual teeth elements, respective switch trigger means integrally formed on each said tooth element, a switch actuator means for activation of said switch when engaged with said trigger means, means for driving said chain past said switch actuator means, and means for interconnecting said teeth elements such that each said tooth element is relatively displaceable laterally of the driving direction of said chain.

6. The apparatus according to claim 5, further comprising a housing having guide surface means cooperating with said tooth elements.

7. The apparatus according to claim 6, further comprising bearing pinions in said housing for wrapping said chain along interior wall surfaces of said housing.

8. The apparatus according to claim 5, wherein said teeth elements have truncated inner ends.

9. The apparatus according to claim 8, wherein said chain is propelled over a pinion having gear spaces for corresponding engagement with said truncated inner ends of said teeth elements.

10. The apparatus according to claim 5, wherein said interconnection means are provided by corresponding circular peg and groove members integrally formed on adjacent tooth surfaces.

11. The apparatus according to claim 5, wherein said interconnection means are provided by corresponding swallow-tail peg and groove members integrally formed on adjacent tooth surfaces.

12. The apparatus according to claim 5, wherein said teeth elements are formed from a synthetic resin material.

* * * * *